US008246481B2

(12) United States Patent
Stites et al.

(10) Patent No.: US 8,246,481 B2
(45) Date of Patent: Aug. 21, 2012

(54) PUTTERS WITH ENHANCED ALIGNMENT VISUALIZATION

(75) Inventors: John Thomas Stites, Weatherford, TX (US); Alan W. Reichow, Beaverton, OR (US); Andrew G. V. Oldknow, Beaverton, OR (US); Sean Miller, Beaverton, OR (US); David N. Franklin, Granbury, TX (US)

(73) Assignee: NIKE, Inc., Beaverton, OR (US)

( * ) Notice: Subject to any disclaimer, the term of this patent is extended or adjusted under 35 U.S.C. 154(b) by 243 days.

(21) Appl. No.: 11/777,740

(22) Filed: Jul. 13, 2007

(65) Prior Publication Data

US 2009/0017933 A1 Jan. 15, 2009

(51) Int. Cl.
*A63B 69/36* (2006.01)
*A63B 53/04* (2006.01)

(52) U.S. Cl. ..... 473/254; 473/242

(58) Field of Classification Search ..... 473/219–356; D21/733–753, 759
See application file for complete search history.

(56) References Cited

U.S. PATENT DOCUMENTS

| | | | | | |
|---|---|---|---|---|---|
| 58,209 | A | * | 9/1866 | Bacheller | 261/73 |
| 1,291,967 | A | | 1/1919 | McDougal | |
| D58,209 | S | * | 6/1921 | Bacheller | D21/745 |
| 2,534,947 | A | | 12/1950 | Bright | |
| 2,842,369 | A | | 7/1958 | East | |
| 2,934,347 | A | | 4/1960 | Siniscalchi | |
| 3,143,349 | A | * | 8/1964 | Macintyre | 473/338 |
| 3,191,936 | A | | 6/1965 | Guier | |
| 3,253,071 | A | | 5/1966 | Hings | |
| 3,459,426 | A | | 8/1969 | Sherwood | |
| 4,077,633 | A | | 3/1978 | Studen | |
| 4,174,839 | A | * | 11/1979 | Marrs | 473/252 |
| D282,952 | S | * | 3/1986 | Mattingly | D21/746 |
| 4,664,383 | A | | 5/1987 | Aizawa | |
| D302,452 | S | | 7/1989 | Walsh | |
| 4,960,279 | A | * | 10/1990 | Harris, Jr. | 473/251 |
| 4,962,931 | A | * | 10/1990 | Jazdzyk, Jr. | 473/252 |

(Continued)

FOREIGN PATENT DOCUMENTS

JP 6-315549 11/1994

(Continued)

OTHER PUBLICATIONS

Anonymous: "The Black Widow Putter" Internet Article, [online] Nov. 14, 2006, retrieved from the Internet: URL: http://web.archive.org/web/20061114025339/http://www.sweetspot.com/products/blkwidsc.cfm.

(Continued)

*Primary Examiner* — Nini Legesse
(74) *Attorney, Agent, or Firm* — Banner & Witcoff, Ltd.

(57) ABSTRACT

Putters and putter heads better camouflage the main body of the head and/or highlight the alignment aid. The top surface of the head (when viewed from a ball address orientation) may be finished in a non-reflective, matte finish, optionally, in a dark color and/or in a color or colors selected so as to blend into or match the color of a golf green. At least some portion of the shaft member may be colored and finished in this same manner. These features help in visualization of the alignment aid (which also may be designed to help in alignment). If desired, the club head and/or shaft color and finish may be customized based on the greens at a specific golf course, greens in a specific geographical region, greens of a specific grass type, greens at a specific time of year or under specific conditions, etc.

21 Claims, 7 Drawing Sheets

U.S. PATENT DOCUMENTS

| | | | | |
|---|---|---|---|---|
| 5,174,573 | A | 12/1992 | Desbiolles et al. | |
| 5,228,695 | A | 7/1993 | Meyer | |
| D389,208 | S | 1/1998 | Phillips | |
| 5,720,668 | A | 2/1998 | Brett | |
| 5,792,007 | A | 8/1998 | Billings | |
| D397,752 | S | 9/1998 | Cameron | |
| D398,353 | S | 9/1998 | Wooten | |
| 5,890,977 | A | 4/1999 | Taylor | |
| D411,867 | S | 7/1999 | Cameron et al. | |
| 5,938,543 | A | 8/1999 | McGeeney et al. | |
| 6,129,435 | A | 10/2000 | Reichow et al. | |
| 6,183,377 | B1 | 2/2001 | Liang | |
| 6,200,229 | B1 | 3/2001 | Grace et al. | |
| 6,244,974 | B1 * | 6/2001 | Hanberry, Jr. | 473/242 |
| 6,386,991 | B1 | 5/2002 | Reyes et al. | |
| 6,435,979 | B1 | 8/2002 | Mounfield, Jr. | |
| 6,435,981 | B2 | 8/2002 | Naruo et al. | |
| 6,631,987 | B2 | 10/2003 | Reichow et al. | |
| D499,782 | S | 12/2004 | Stites et al. | |
| D501,233 | S | 1/2005 | Thomas | |
| 6,893,127 | B2 | 5/2005 | Reichow et al. | |
| 7,022,030 | B2 | 4/2006 | Best et al. | |
| 7,077,758 | B2 * | 7/2006 | Rohrer | 473/251 |
| 7,090,591 | B2 | 8/2006 | Sano | |
| 7,156,752 | B1 * | 1/2007 | Bennett | 473/334 |
| D565,684 | S * | 4/2008 | Homma | D21/759 |
| 7,351,162 | B2 | 4/2008 | Soracco et al. | |
| 7,371,184 | B2 * | 5/2008 | Tao | 473/242 |
| 7,371,185 | B1 | 5/2008 | Rohrer | |
| 7,594,865 | B2 | 9/2009 | Ines | |
| 7,648,425 | B2 | 1/2010 | Wahl et al. | |
| 2002/0039931 | A1 | 4/2002 | Cynn | |
| 2002/0160858 | A1 | 10/2002 | Lee | |
| 2002/0183133 | A1 | 12/2002 | Sano | |
| 2003/0119600 | A1 | 6/2003 | Nelson | |
| 2004/0092328 | A1 | 5/2004 | Patsky | |
| 2004/0173964 | A1 * | 9/2004 | Pollman | 273/252 |
| 2005/0037857 | A1 * | 2/2005 | Best et al. | 473/340 |
| 2005/0064956 | A1 | 3/2005 | Lee | |
| 2005/0090332 | A1 | 4/2005 | Burrows | |
| 2005/0096154 | A1 | 5/2005 | Chen | |
| 2005/0164800 | A1 | 7/2005 | Wood et al. | |
| 2005/0170920 | A1 | 8/2005 | Boyer et al. | |
| 2005/0187028 | A1 | 8/2005 | Chang et al. | |
| 2006/0000011 | A1 | 1/2006 | Reichow et al. | |
| 2006/0014590 | A1 * | 1/2006 | Tao | 473/249 |
| 2006/0019768 | A1 | 1/2006 | Lo | |
| 2006/0058111 | A1 | 3/2006 | Kumamoto | |
| 2006/0185066 | A1 | 8/2006 | Page et al. | |
| 2006/0293113 | A1 | 12/2006 | Pelz | |

FOREIGN PATENT DOCUMENTS

| | | |
|---|---|---|
| JP | 8-196666 | 8/1996 |
| JP | 2004-194909 | 7/2004 |
| JP | 2004-209021 | 7/2004 |
| JP | 2006-110008 | 4/2006 |
| WO | 2004062735 | 7/2004 |

OTHER PUBLICATIONS

Partial International Search Report in corresponding PCT Application, International Application No. PCT/US2008/069737, mailed Nov. 26, 2008.

Douglas E. Karcher and Michael D. Richardson: "Turfgrass Science, Quantifying Turfgrass Color Using Digital Image Analysis," Crop Sci. 43, pp. 943-951 (2003).

PGA.com Value Guide, "Wilson Green Machine 2 Putter," 2 pages at http://valueguide.pga.com/detail-exec/brand/2775/product_type/206/mode1/44040/b/Wils... Internet search performed on Dec. 19, 2006.

"The Frog" designed by Frank Thomas at Frankly Golf, 1 page at http://www.franklygolf.com/frog_land.asp.

Anonymous: "SeeMore Putter" Internet Article, [Online] Dec. 30, 2006, XP002503550, Retrieved from the internet: URL:http://web.archive.org/web/20061230202101/http://seemore.com/ [retrieved on Nov. 12, 2008] the whole document, 2 pages.

U.S. Office Action in related U.S. Appl. No. 11/777,734 dated Jun. 11, 2009.

U.S. Office Action in related U.S. Appl. No. 11/777,734 dated Nov. 6, 2009.

U.S. Office Action in related U.S. Appl. No. 11/777,734 dated Dec. 29, 2009.

U.S. Office Action in related U.S. Appl. No. 12/789,150 dated Sep. 20, 2010.

Canadian Office Action in related Canadian Application No. 2,692,162, dated Jul. 12, 2011.

U.S. Office Action related in U.S. Appl. No. 12/789,150; mailed Aug. 2, 2011.

Chinese Office Action related in Chinese Application No. 200880101077.0; received from Chinese Foreign Associate on Nov. 10, 2011.

Canadian Office Action in related Canadian Application No. 2,692,162 dated May 7, 2012.

* cited by examiner

PUTTERS WITH ENHANCED ALIGNMENT VISUALIZATION

FIELD OF THE INVENTION

This invention relates generally to putters and putter heads for golf produced to better avoid visual distractions and suppress erroneous visual cues during alignment and/or swinging and/or to better highlight the alignment aid(s) of the putter.

BACKGROUND

The importance of vision and the human eye's response to light in the course of athletic activities cannot be understated. In recent years, advancements have been made that better allow the athlete to view objects during athletic activities. For example, U.S. Pat. Nos. 6,631,987 and 6,893,127 to Dr. Alan W. Reichow, et al. describe optical filters and eyewear including such filters that enhance the wearer's visual perception of objects, such as golf balls. Each of these patent documents is entirely incorporated herein by reference.

Sporting equipment itself also may be designed to improve aspects of its interaction with light and/or the manner in which it is viewed by the athlete during an athletic performance. For example, U.S. Patent Publication No. 2005/0170920 A1 describes an enhanced-visibility ball structure, such as a soccer ball, that includes regions having enhanced-visibility colors. U.S. Patent Publication No. 2006/0185066 A1 describes a protective facemask (e.g., for a baseball or softball catcher, for football, etc.) having a multi-colored interior surface matched to visual characteristics of its use environment. Each of these patent publications also is entirely incorporated herein by reference.

Like other sports, accurate vision is very important in golf. Vision is important for many golfing activities, particularly in properly aligning oneself for a golf shot and/or in reading golf greens. Despite recent technological advances in golf equipment, putting remains a difficult portion of the game for many golfers. Putting requires golfers to perform a number of independent tasks, consider information relating to a number of different variables, and then combine the results of these tasks and analyses into a physical golf stroke. More specifically, first, the golfer must "read" the green to determine the desired speed at which to propel the ball (i.e., the force to apply to the ball by the putter) and the desired direction to propel the ball. These features are dependent on one another in that a given putt generally may be propelled at a variety of different speeds and a variety of different directions, and certain combinations of speed and direction (particularly over sloped terrain, like most golf greens) will result in successfully putting the ball into the hole. For example, a putt hit in a first direction may miss the hole (by going "above" the hole or "below" the hole) at a first speed, but a putt propelled in the same direction at a different speed (or within a relatively narrow range of speeds) may go into the hole. Similarly, a putt may be hit within a range of different directions, provided the golfer properly adjusts the putt's speed for the specific direction hit. After reading the green (e.g., considering its "slope") and deciding on a line and speed, the golfer then must hit the ball with the putter in the desired direction at the desired speed. Deviations in any of these judgments or execution may lead to missed putts.

Many factors can cause a golfer to hit a putt in the wrong direction, even when the golfer correctly judges the direction that the putt should be hit. For example, after the golfer has determined the desired line of the putt, he or she typically changes position to address and then hit the ball. Golfers may lose track of the desired line and/or inadvertently misalign themselves as they transfer their body from the putt reading position to the putt address position.

Additionally, before or during the course of a swing, the putter head may twist or otherwise misalign thereby causing the putt to drift off the desired line. This problem can be exacerbated when the club head itself contains sources of visual distraction, such as shiny surfaces, sharp corners or edges, etc. For example, when these visual distractions catch a user's eye as the putter swings, it may cause the golfer's eye, head, or other part of the body to move at least slightly, which can adversely impact the speed and/or direction of putter movement. Moreover, these visual distractions can obscure visualization of the club head's alignment aid, another feature that can adversely impact putting direction.

Fatigue also can play a role in putting processes. Visual attention and concentration in activities over long periods of time where fatigue can play a role, such as golf, especially under the harsh, varied, and changing environmental light conditions encountered during golf, is more readily maintained when the detail of interest (e.g., the alignment aid) is the brightest (strongest visual signal) throughout the visual field. Distracting features of putter heads and putter motion, as described above, can cause even more problems as fatigue sets in over the course of the golfer's round.

Accordingly, advancements in putters that help keep golfers better aligned and/or avoid visual distractions during putting would be welcome in the art.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

In general, aspects of this invention relate to putters and putter heads that include: (a) a club head body having a ball striking face and a top surface when viewed from a ball address orientation, wherein a majority of the top surface has a non-reflective, matte finish (optionally in one or more dark colors, such as green, black, brown, dark gray, dark tan, etc.), optionally, in a color or colors selected so as to substantially blend into or substantially match a color of a grass on a golf green; (b) an alignment aid provided on or integrally formed as part of the top surface, wherein the alignment aid optionally is formed in one or more luminescent, reflective, and/or bright colors (such as "highlighter" type colors, including, for example, luminescent or fluorescent white, yellow, pink, purple, orange, blue, or green) (e.g., highly contrasting with respect to the other top surface color(s)), and wherein the alignment aid (in one or more independent parts) covers less than a majority of the top surface of the club head body; (c) a shaft member engaged with the club head body, optionally, wherein at least a portion of the shaft member adjacent to the club head body has a non-reflective, matte finish (optionally in a color and/or finish selected so as to substantially blend into or substantially match a color of the top surface and/or a color of grass on a golf green); and/or (d) a grip or handle member engaged with the shaft member. Such putters and putter heads may be structured, colored, and finished so as to reduce or minimize extraneous or distracting visual information on the putter's top surface and/or so as to better highlight and focus the golfer's attention on the alignment aid. These goals may be further advanced in some structures in accordance with this invention, at least in part, by designing the alignment aid in specific desired shapes; by placing the alignment aid(s) at various desired positions on the club head's top surface; by rounding off the corners or edges of the top surface (to avoid sharp corners or edges, to avoid abrupt surface level changes, etc.); by covering all or substantially all of the top surface with either the matte finish or the alignment aid (and thereby avoiding other visual distractions); by coloring and finishing the shaft in the same manner as the top surface; etc.

Methods according to at least some examples of this invention further may include steps involved in selecting the particular color for the finish of the club head and/or shaft member. Darker colors tend to be less visually distracting and provide a good background to enable a highly contrastingly colored alignment aid (e.g., in a luminescent or fluorescent color) to appear. In some examples according to this invention, the shaft member and/or the top surface of the club head will be colored and/or finished so as to better blend into the background during use, namely, the golf green. Such methods may include, for example: (a) investigating a grass color of a specific golf green, a specific set of greens (e.g., those on a specific course, those in a specific geographical region, those of a specific type of turfgrass, etc.); and (b) creating a finish color for the putter head and/or shaft, at least in part, based on the grass color, wherein the finish color is applied to the putter head and/or shaft during its production. The "investigating" may include spectral analysis of the grass color (e.g., determination of its light reflectance properties, its light absorption properties, its luminescence, etc.). In this manner, putter heads and/or shafts may be specifically designed to target the color, for example, of greens at a specific golf course, of greens in a specific region (e.g., the Pacific Northwest, Florida, Texas, Arizona, etc.), of greens of a specific grass type (e.g., bent grass, bluegrass, etc.), of greens at a specific time of year or under specific lighting, weather, or climate conditions, etc.

Such club head and/or shaft structures may be incorporated into an overall golf club structure and/or used as a golf club in any desired manner, including in conventional manners that are known and used in the art.

BRIEF DESCRIPTION OF THE DRAWINGS

A more complete understanding of the present invention and certain advantages thereof may be acquired by referring to the following detailed description in consideration with the accompanying drawings, in which.

Figure 1A:
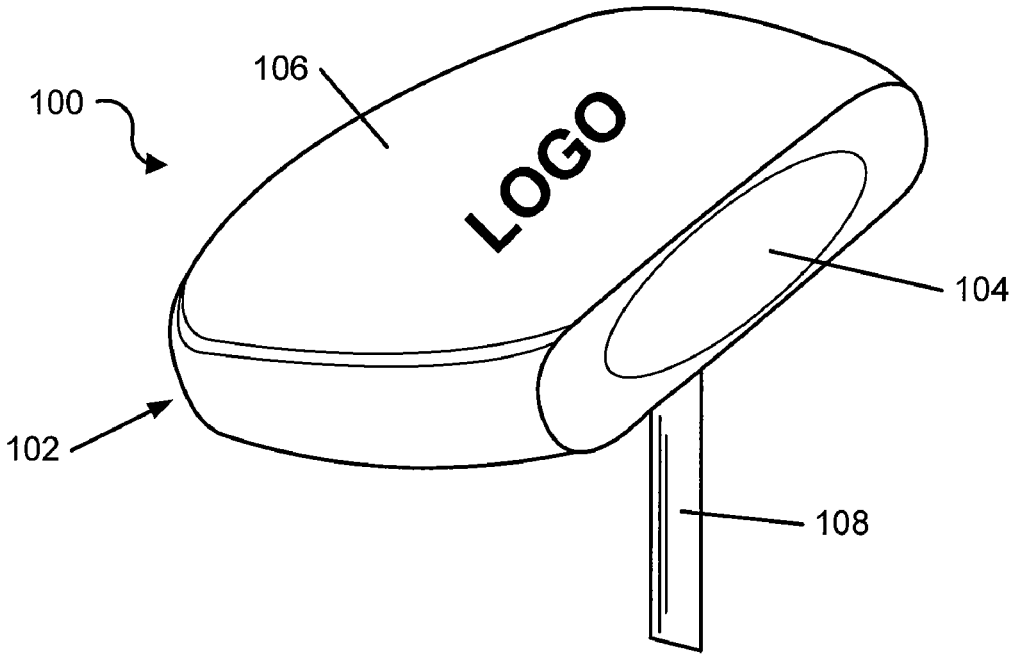
FIGS. 1A through 1D illustrate a putter structure including features according to at least some example aspects of this invention.
Figure 1B:
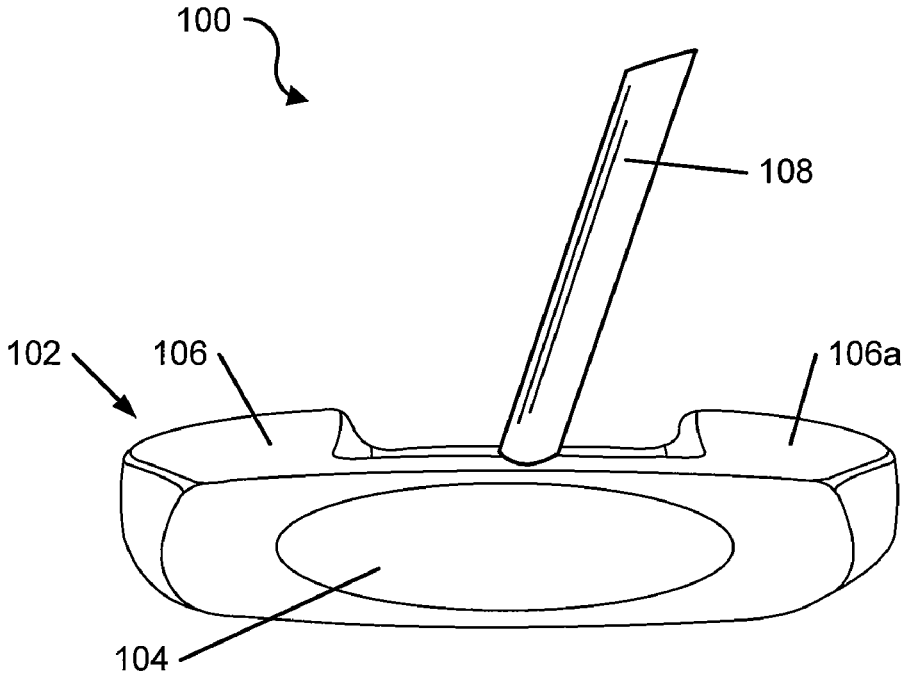

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example golf club heads and golf club structures in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

A. General Description of Putter Heads and Putters According to Examples of the Invention In general, as described above, aspects of this invention relate to putters and putter heads for use in golf. In accordance with at least some aspects of this invention, putter heads according to this invention may include: (a) a club head body having a ball striking face and a top surface when viewed from a ball address orientation, wherein a majority of the top surface has a non-reflective, matte finish in one or more dark colors (such as green, black, brown, dark gray, dark tan, etc.); and (b) an alignment aid provided on or integrally formed as part of the top surface, wherein the alignment aid is formed in one or more luminescent, reflective, bright colors (such as "highlighter" type colors, including, for example, luminescent or fluorescent white, yellow, pink, purple, orange, blue, or green) (e.g., highly contrasting with respect to the other top surface color(s)), and wherein the alignment aid covers less than a majority of the top surface of the club head body. This combination of features controls the luminous (brightness) and/or chromatic (color) contrast between the club head body, the alignment aid, and/or the background so as to allow the alignment aid to better "stand out" in the golfer's vision, against the club head and/or background. When incorporated into a putter structure, a shaft member may be engaged with the putter head, and a grip member or other handle element may be engaged with the shaft member.

While the alignment aids on putter heads in accordance with examples of this invention may take on a variety of forms, more specific examples of alignment aid constructions also form at least some example aspects of this invention. When viewed from the ball address orientation, the top surface of the putter head may include a ball striking face front portion (adjacent the ball striking face) and a main body portion extending back from the ball striking face portion and away from the ball striking face. In accordance with at least some examples of this invention, the alignment aid may be a two part aid that includes a first portion located on or integrally formed as part of the main body portion of the top surface and a second portion located on or integrally formed as part of the ball striking face portion of the top surface. In some more specific examples in accordance with this invention, the main body portion of the alignment aid may include a triangular shaped element, optionally an isosceles triangle and optionally having a flat side located proximate to and extending substantially parallel to the ball striking face and a single apex area located toward a center rearmost portion of the main body portion. Additionally or alternatively, if desired, the ball striking face portion of the alignment aid may include a line or an elongated substantially polygon shaped element extending along the ball striking face portion (and optionally parallel to the flat side of the triangular shaped portion).

In accordance with at least some example aspects of this invention, the top surface of the putter head will be colored and constructed so as to minimize extraneous visual information (such as the majority of the putter head) and to highlight the alignment aid visual information. This may be accomplished, at least in part, by constructing the top surface of the putter head so that it contains little or nothing more than the non-reflective, matte finish color and the alignment aid (e.g., little or nothing else shiny or reflective; small or no logos, model numbers, or other identifying information; little or no other color changes; etc.). In some examples of this invention, at least 65% of the top surface (percentage of top surface visible from the ball address position) will have the non-reflective, matte finish, and even at least 75% or even at least 85% of the top surface will have the non-reflective, matte finish. As for the alignment aid, in some specific examples of this invention, less than 35% of the top surface will include the alignment aid, and even less than 25% or less than 15% of the top surface may constitute the alignment aid. In at least some examples of putter head structures according to this invention, at least 85% of the top surface coloring will consist of the combination of: (a) the non-reflective, matte finish and (b) the alignment aid, and in other examples, this percentage may be at least 90%, at least 95%, at least 98%, or even at least 99%. As apparent from the above discussion, if desired, the top surface coloring of the putter head may consist essentially of: (a) the non-reflective, matte finish and (b) the alignment aid in putter head and putter structures in accordance with this invention.

Other features of putter heads and/or putter structures may help reduce or minimize distracting and/or extraneous visual information and help highlight the alignment aid in accordance with some examples of this invention. For example, sharp corners and edges in structures can be more visually apparent when viewed by the human eye, particularly when the structures are set in motion. Therefore, if desired, the top surface of the putter head may be constructed so that it includes few (if any) sharp corners and/or abrupt surface elevation changes visible from the ball address orientation. In other words, the top surface of the putter head may be constructed to have smoothly rounded corners and smoothly transitioned surface elevation changes. This may be accomplished, for example, by casting, molding, machining, and/or otherwise constructing the putter head such that all (or substantially all) top surface visible rounds, fillets, or other corners have a rounded or radiused character (e.g., at least 0.25 mm radius, and in some examples, at least 0.5 mm, at least 1 mm, at least 2 mm, at least 5 mm, or even at least 10 mm). Similarly, all (or substantially all) visible edges and/or other elevational changes present on the top surface of the club head may be rounded off to avoid abrupt surface elevation changes (e.g., rounded or radiused edges of at least 0.25 mm radius, and in some examples, at least 0.5 mm, at least 1 mm, at least 2 mm, at least 5 mm, or even at least 10 mm; sloped walls between adjacent surfaces, etc.).

The putter shaft also can be a source of visual distraction (e.g., because of its typical shiny appearance, because of its contrasting color with respect to the club head and/or ground, etc.). In accordance with at least some examples of this invention, at least a portion of the shaft member adjacent to the putter head may be constructed to have a non-reflective, matte finish in one or more dark colors, e.g., optionally colors and finishes as described above, selected so as to substantially match the color and/or finish of the majority of the top surface of the club head body. While any portion of the putter shaft may be colored and/or finished in this manner, in accordance with at least some examples of this invention, at least 10% of an overall length of the shaft member will be colored and/or finished in the non-reflective matte finish as described above, and in some more specific examples, at least 25%, at least 50%, or even at least 75% of the overall length of the shaft member may be colored and/or finished in this manner. If desired, an entire visible portion (or at least substantially the entire visible portion (e.g., exclusive of printing, etc.) of the shaft member will include the non-reflective, matte finish optionally in a color and/or finish that matches or substantially matches that of the top surface of the club head.

Additional aspects of this invention relate to putter head and putter structures having one or more of the following: (a) a club head body having a ball striking face and a top surface when viewed from a ball address orientation, wherein a majority of the top surface has a non-reflective, matte finish, in a green color, and wherein, optionally, the color or colors of the matte finish are selected so as to substantially blend into or substantially match a color of a grass on a golf green; (b) an alignment aid provided on or integrally formed as part of the top surface, wherein the alignment aid optionally may be formed in one or more highly contrasting (e.g., luminescent, reflective, bright, etc.) colors and covers less than a majority of the top surface of the club head body; (c) a shaft member engaged with the club head body, optionally, wherein at least a portion of the shaft member adjacent to the club head body has a non-reflective, matte finish in a green color (optionally a color and/or finish selected so as to substantially blend into or substantially match a color and/or finish of the top surface and/or the color of the grass on a golf green); and/or (d) a grip or handle member engaged with the shaft member. When colored and/or finished to better blend into the background of the grass, the combination of features controls the luminous (brightness) and chromatic (color) contrast between the club head body, the alignment aid, and/or the background to allow the club head to better blend into the background and to make the alignment aid better "stand out" in the golfer's vision against the club head and/or background. The putter head and/or shaft also may have any of the other features described above (e.g., rounded corners or edges; shaft, alignment aid, and/or matte finish colors; alignment aid shapes, locations, and/or other characteristics; percentages of top surface and/or shaft covered by the matte finish and/or alignment aid(s); etc.).

B. General Description of Example Methods of Making and/or Using Putter Heads and/or Putters According to the Invention Additional aspects of this invention relate to methods of making putter heads and/or putters in accordance with this invention (e.g., of the various types described above). Such methods may include, for example, one or more of the following: (a) finishing at least a top surface of a club head body when viewed from a ball address orientation such that a majority of the top surface has a non-reflective, matte finish (e.g., in one or more dark colors, in a green color, in a color selected to substantially match a color of a golf green, etc.); (b) forming an alignment aid on or as part of the top surface (wherein the alignment aid optionally is formed in one or more highly contrasting (e.g., luminescent, reflective, bright, etc.) colors and covers less than a majority of the top surface of the club head body); (c) engaging a shaft member with the putter head (optionally, wherein at least a portion of the shaft member adjacent to the putter head has a non-reflective, matte finish, and optionally a color and/or finish that substantially matches the color and/or finish of the majority of the top surface of the putter head); and/or (d) engaging a grip member with the shaft member. The putter head and/or shaft also may be formed so as to have any of the other features described above (e.g., rounded corners or edges; shaft, alignment aid, and/or matte finish colors; alignment aid shapes, locations, and/or other characteristics; percentages of top surface and/or shaft member covered by the matte finish and/or alignment aid(s); etc.).

Some methods according to this invention may include further steps to assist in color selection for the top surface and/or shaft member. For example, such methods may include: (a) investigating a grass color of a specific golf green, a specific set of greens (e.g., those on a specific golf course, those in a specific geographical region, those of a specific type of turfgrass, etc.); and (b) creating a finish color for the putter head and/or the shaft member, at least in part, based on the grass color, wherein the finish color is applied to the putter head and/or the shaft during its production. The investigating may include spectral analysis of the grass color (e.g., its light reflectance properties, its light absorption properties, its luminescence, etc.). In this manner, putter heads and/or shafts may be specifically designed or customized with colors corresponding to, for example, the greens at a specific golf course, the greens in a specific region (e.g., the Pacific Northwest, Florida, Texas, Arizona, etc.), the greens of a specific grass type (e.g., bent grass, bluegrass, etc.), the greens at a specific time of year or under specific lighting, weather, or climate conditions, etc.

Specific examples of the invention are described in more detail below. The reader should understand that these specific examples are set forth merely to illustrate examples of the invention, and they should not be construed as limiting the invention.

C. Specific Examples of the Invention

FIGS. 1A through 1D illustrate a first example putter structure 100 in accordance with this invention. As shown in these figures, this example putter structure 100 includes a club head member 102 including a ball striking face 104 attached to or integrally formed as part of a club head body 106. A shaft member 108 is engaged with the club head member 102 in any desired manner, such as via cements or adhesives; via threaded or other mechanical connectors; via welding, brazing soldering, or other fusing techniques; etc. Moreover, the shaft member 108 and/or club head 102 may be made from any desired number of parts and/or any desired materials, including from conventional parts, conventional materials, and in conventional constructions as are known and used in the art.

Figure 1C:
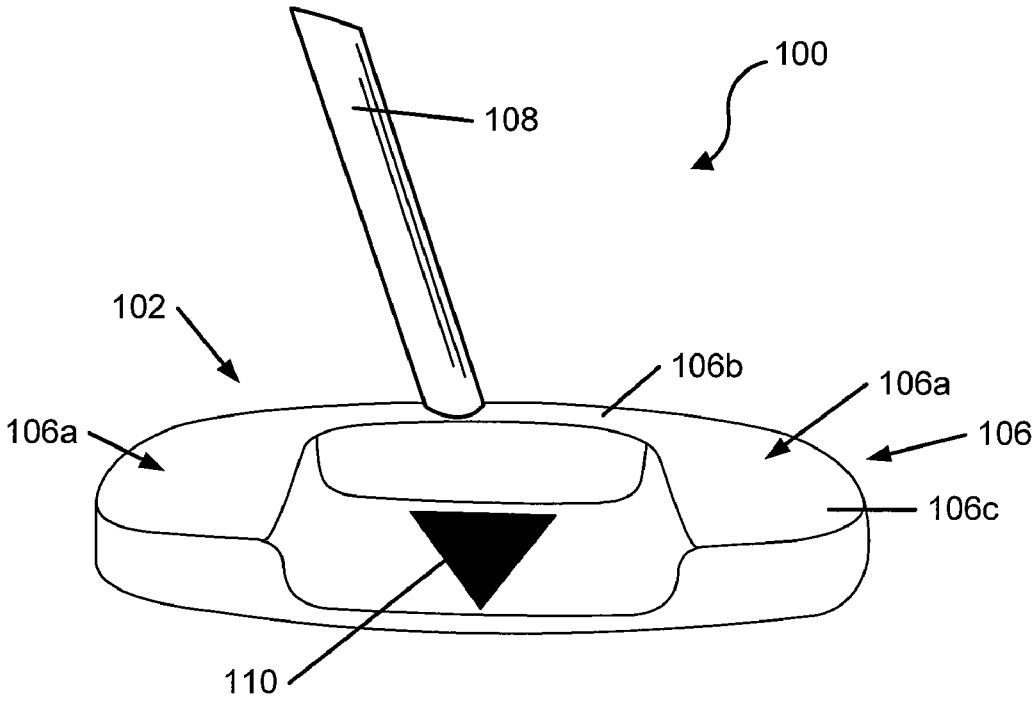
Figure 1D:
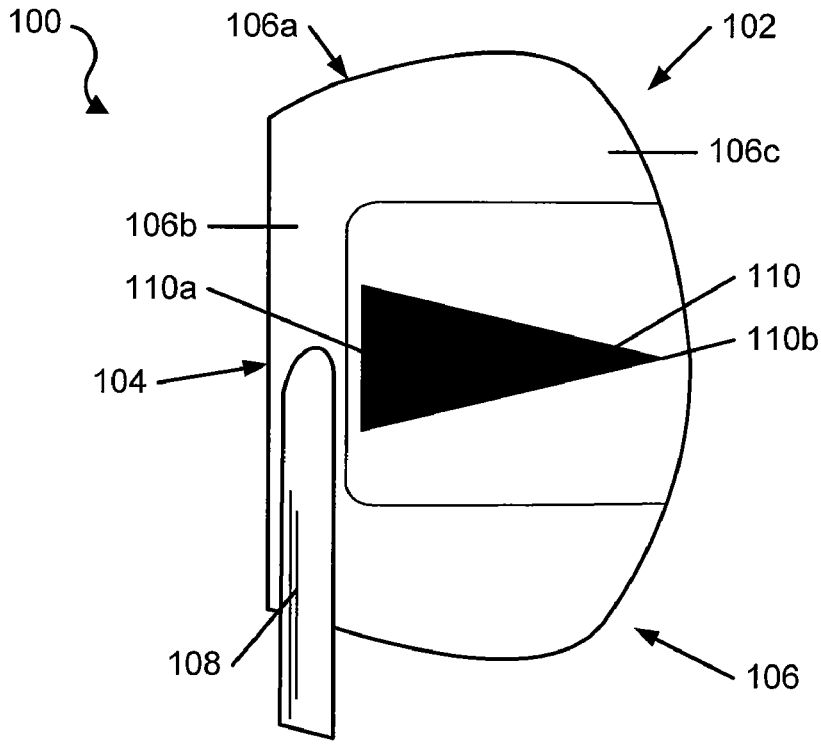

FIGS. 1C and 1D better illustrate the top surface 106*a* of the club head body 106, particularly, the portion of the club head surface visible to a golfer when the club head 102 is placed at a ball address orientation in preparation to putt. The top surface 106*a* may be considered as including two primary portions, namely, the front or ball striking face portion 106*b* (i.e., that portion of the top surface 106*a* immediately adjacent to the ball striking face 104) and the rear or main body portion 106*c* (i.e., the portion of the top surface 106*a* extending from the ball striking face portion 106*b* and away from the ball striking face 104). The ball striking face portion 106*b* may be made from a different material and/or a different part from the main body portion 106*c* (and indeed it may be made from the same physical piece of material making up the ball striking face 104), or these various parts of the club head 102 may be integrally formed with one another as a unitary structure. There may or may not be clear lines of demarcation between the face 104, the ball striking face portion 106*b*, and/or the main body portion 106*c*.

In accordance with at least some example aspects of this invention, the majority of the top surface 106*a* of the club head body 106 is formed so as to have a non-reflective, matte type finish, optionally in a dark color, such as green, black, brown, dark gray, or dark tan. The matte finish may be applied to the club head body 106 in any desired manner without departing from this invention, such as by painting, by anodizing or other electroplating techniques, or the like. The dark color and matte finish helps reduce the golfer's focus on the main body of the putter and helps prevent light from reflecting off the putter head thereby causing a visual distraction as the golfer lines up and/or hits a putt. The term "matte finish," as used herein, is not intended to denote any specific finishing technique or method, but rather it is used generally to refer to any dull or drab finish and/or finishing technique that reflects little light.

FIGS. 1C and 1D further illustrate an alignment aid 110 that is included on the top surface 106*a* of the putter head 102. Alignment aids in accordance with at least some examples of this invention may be made in a highly contrasting color (e.g., a luminous or fluorescent type color that greatly reflects light). While the alignment aid 110 may be in any desired color, in at least some examples of this invention it will be made in a color that highly contrasts with the dull dark color of the remainder of the top surface 106*a* of the club head body 106 and/or highly contrasts with the background green, such as bright, luminous white or luminous or fluorescent "highlighter" type colors, e.g., yellow, pink, purple, orange, blue, green, etc.

The alignment aid 110 may be provided on or formed with the club head 102 in any desired manner without departing from this invention. For example, if desired, the alignment aid 110 may be painted on or otherwise applied to or integrally formed as part of the club head structure 102. As another example, if desired, the alignment aid 110 may be a separate element (e.g., a metal plate, a plastic plate, etc.) that fits into a recess or is otherwise attached to the club head 102, e.g., using mechanical connectors; cements or adhesives; fusing techniques; etc. If desired, the alignment aid 110 may be made removable so that it can be replaced by another, e.g., of different size, shape, design, color, etc.

The combination of the dull and dark body color with the bright, highly contrasting alignment aid 110 helps avoid focusing the golfer's eye and attention on any visual information associated with the club head body 106 and helps focus the golfer's eye and attention on the alignment aid 110. As noted above, a majority of the top surface 106*a* of the club head body 106 may be colored with the drab, dull color (in a matte finish) while the remainder (or substantially the remainder) of the top surface comprises the alignment aid 110. If desired, in accordance with at least some examples of this invention, the top surface 106*a* of the putter head 102 may be colored and/or finished so that it contains little or nothing more than the non-reflective, matte finish color and the alignment aid (e.g., little or nothing else shiny or reflective; small or no logos, model numbers, or other identifying information; no visible joints or junctions between parts; etc.). In some more specific examples of club head structures according to this invention, at least 65% of the top surface (percentage of top surface visible from the ball address position) will have the non-reflective, matte finish, and even at least 75% or even at least 85% of the top surface will have the non-reflective, matte finish. As for the alignment aid, in some specific examples of this invention, less than 35% of the top surface will include the alignment aid, and even less than 25% or less than 15% of the top surface may constitute the alignment aid. In at least some examples of this invention, at least 85% of the top surface coloring will consist of the combination of: (a) the non-reflective, matte finish and (b) the alignment aid, and in other examples, this percentage may be at least 90%, at least 95%, at least 98%, or even at least 99%. As apparent from the above discussion, if desired, the top surface coloring of the putter head may consist essentially of: (a) the non-reflective, matte finish and (b) the alignment aid in putter head and putter structures in accordance with this invention. Other distracting visual features of the top surface, such as visible joints between parts, any textual information, etc., may be masked, hidden, or otherwise at least partially camouflaged or concealed. While portions of the putter structure not typically visible during a putt (e.g., the sole) may be colored, designed, and/or otherwise structured in any desired manner and/or include any desired information (such as logos, etc., see FIG. 1A) without departing from the invention, these surfaces also may be colored in the matte finish or otherwise consistent with the remainder of the club head structure, if desired.

The shape of the alignment aid 110 also can be useful to help focus the golfer's eye for alignment purposes. As shown in FIGS. 1C and 1D, this specific example alignment aid 110 is triangular shaped (an isosceles triangle) having one flat side edge 110*a* extending substantially parallel to the ball striking face 104 and having an apex 110*b* located toward a central rearmost portion of the club head body 102. This alignment aid 110 shape, when viewed from above in the ball address orientation, helps draw the viewer's eye forward, toward the ball and ball striking face 104, and helps the golfer with alignment of the club head's center of gravity location with the ball (in this example arrangement 100, the center shaft mount may be considered as forming a second portion of the alignment aid). The parallel nature of the triangle's flat side edge 110*a* with the ball striking face 104 helps in the direction alignment process.

Figure 2:
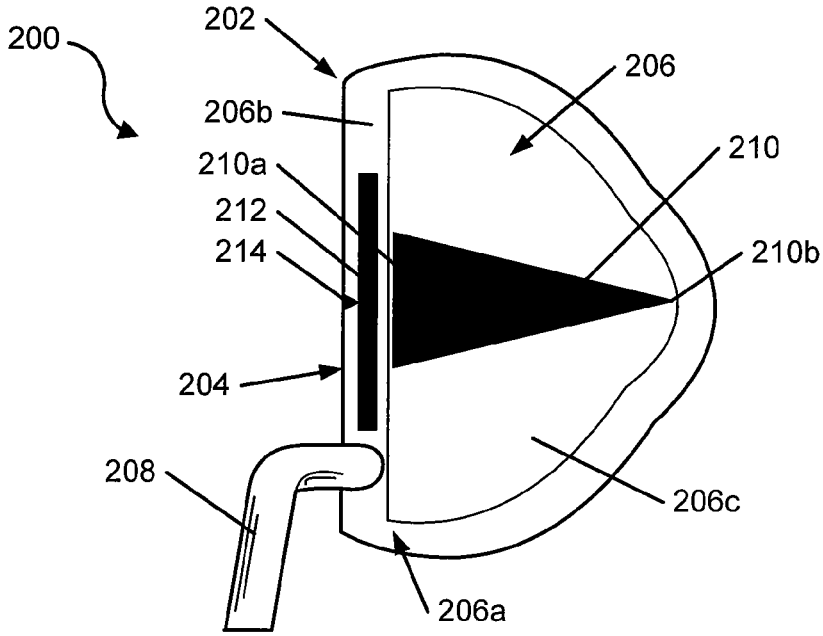
FIG. 2 illustrates another example putter structure including features according to at least some example aspects of this invention.

FIG. 2 illustrates an overhead view (e.g., in ball address position) of another putter structure 200 in accordance with at least some examples of this invention. While this example putter 200 is similar to that shown in FIGS. 1A through 1D (e.g., including a putter head 202, a ball striking face 204, a body member 206 having a top surface 206*a* (including a ball striking face portion 206*b* and a main body portion 206*c*), and a shaft 208), there are some notable differences. First, as is readily evident, the overall putter head 202 has a different shape from that illustrated in FIGS. 1A through 1D. Aspects of this invention may be practiced with any desired type of putter structure, including mallet type putters, blade type putters, heavy putters, large body putters, and the like.

Moreover, the putter 200 of FIG. 2 has a different alignment aid as compared to that of FIGS. 1A through 1D. The alignment aid of FIG. 2 has multiple different parts. Specifically, in this illustrated example, the alignment aid has a first triangular portion 210 (with flat side 210*a* and apex 210*b*) shaped and arranged on the main body portion 206*c* of the club head body 206 in much the same manner as the alignment aid 110 illustrated in FIGS. 1C and 1D. The second part 212 of the alignment aid of FIG. 2 is included as part of the ball striking face portion 206*b* of the top surface 206*a* of the club head body 206. Specifically, in this example structure 200, the second part 212 of the alignment aid extends as a line (or an elongated polygon structure) along the ball striking face portion 206*b* parallel to (or substantially parallel to) the ball striking face 204 and/or parallel to (or substantially parallel to) the flat side 210*a*. Like the flat side 210*a* of alignment aid 210, this elongated line or polygon structure 212 helps draw the golfer's eye and attention forward, toward the ball, and helps the golfer better see the alignment of the face 204 and concentrate on alignment of the club head's center of gravity with a ball. If desired, as shown in FIG. 2, the position of the club head's center of gravity also may be marked on the top surface 206*a* of the club head 202, e.g., by a notch or other center of gravity designator 214. This center of gravity designator 214 also helps draw the golfer's eye and attention forward, toward the ball, and helps the golfer better see and concentrate on alignment of the club head's center of gravity with a ball. The elongated character of the alignment aid 212 (and its highly contrasting color, if made in that manner) provides a good visual indication of the face 204 direction and orientation with respect to the ball.

Figure 3A:
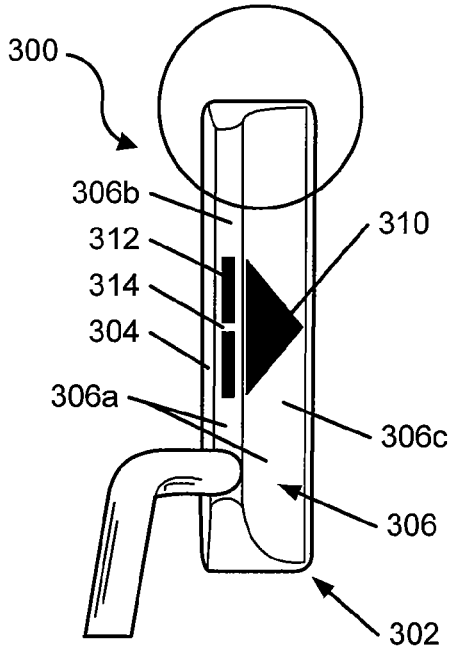
FIGS. 3A and 3B illustrate another example putter structure including features according to at least some example aspects of this invention.

FIG. 3A illustrates another example putter structure 300 in accordance with this invention. In this example structure 300, a two part alignment aid (including triangular portion 310 and line or elongated polygon alignment aid portion 312) similar to that illustrated in FIG. 2 is applied to a blade type putter body 302. In this example structure 300, however, the position of the center of gravity is marked on the top surface 306*a* of the club head 302 by a contrasting color portion 314 applied across the line or elongated polygon alignment aid portion 312. This contrasting color portion 314 helps draw the golfer's eye and attention forward, toward the ball, and helps the golfer better concentrate on alignment of the club head's center of gravity with the ball. As opposed to a strongly contrasting color, if desired, the center of gravity position 314 may be marked by a notch, star, indentations, or other mark or manner without departing from this invention.

Figure 3B:
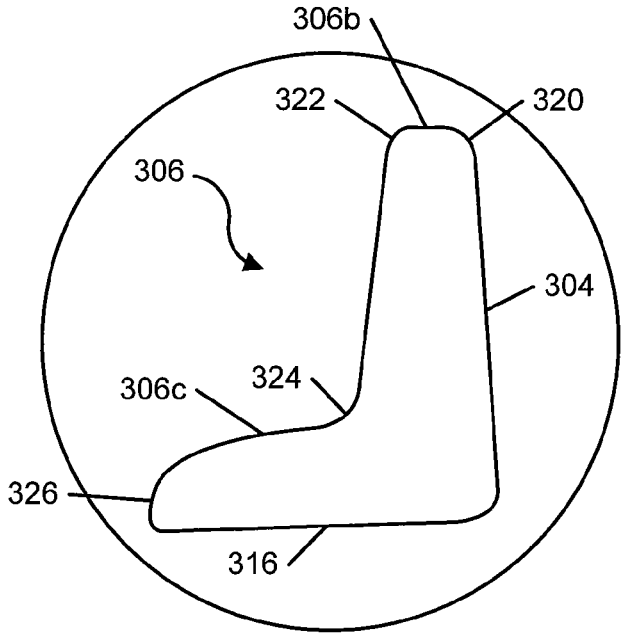

FIGS. 3A and 3B illustrate another feature that may be provided in putter structures in accordance with at least some examples of this invention. Sharp corners and edges of elements tend to stand out visually to a viewer, both when an object stands stationary and when set in motion. To reduce the visual distractions to the golfer during a putt, the top surface 306*a* of the putter structure 300 (or another of the putter structures described herein) may be formed so as to avoid or reduce the number of sharp corners, sharp edges, and/or abrupt surface elevation changes (and/or to reduce the length of any visible sharp edges or abrupt surface elevation changes). In other words, at least some of the visible corners and edges of the putter structure 300 may be smoothly rounded so as to avoid sharp corners and edges. This feature is illustrated more clearly in the side view of the putter 300's toe end in FIG. 3B. As shown in FIG. 3B, rounded edge 320 smoothly transitions from the ball striking face portion 306*b* of the top surface 306*a* to the ball striking face 304 without providing an abrupt (e.g., squared) corner or edge. Similarly, rounded edge 322 and rounded edge 324 smoothly transition the top surface 306*a* between the ball striking face portion 306*b* and the main body portion 306*c*. Likewise, the rearmost edge 326 of the visible top surface 306*a* is rounded and smoothly transitions between the main body portion 306*c* and the club head sole 316.

If desired, the putter head 300 (and/or the other putter heads described herein) may be constructed with rounded corners and/or edges, for example, by casting, molding, machining, or otherwise constructing the putter head 300. In this manner, the putter head 300 may be constructed such that all (or substantially all) top surface visible corners have a rounded or radiused character (e.g., at least 0.25 mm radius, and in some examples, at least 0.5 mm, at least 1 mm, at least 2 mm, at least 5 mm, at least 10 mm, at least 15 mm, and even at least 20 mm). Similarly, all (or substantially all) edges present on the top surface of the club head may be rounded off to avoid abrupt surface elevation changes (e.g., rounded or radiused edges of at least 0.25 mm radius, and in some examples, at least 0.5 mm, at least 1 mm, at least 2 mm, at least 5 mm, at least 10 mm, at least 15 mm, and even at least 20 mm; sloped walls between adjacent surfaces, etc.). The smooth and rounded character of the top surface helps draw the eye and better focus the golfer's attention on the alignment aid(s) (e.g., 310, 312, 314) and the ball. As noted above, any joints between club head parts that are visible from the top surface may be hidden or at least somewhat camouflaged.

Figure 4:
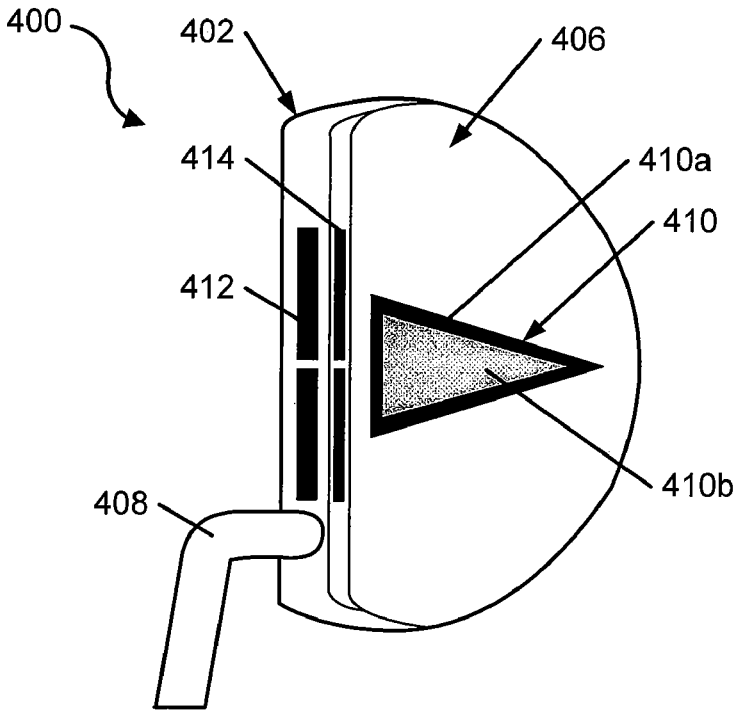
FIGS. 4 through 8 illustrate additional example putter structures including features according to at least some example aspects of this invention.

Use of other alignment aid structures or features also are possible without departing from this invention. For example, FIG. 4 illustrates a putter structure 400 that includes a three part alignment aid, namely a triangular main body portion alignment aid 410, a linear ball striking face portion alignment aid 412, and an intermediate alignment aid portion 414 located between the other alignment aid portions 410 and 412. In this example structure 400, the triangular alignment aid 410 includes a contrasting border region 410*a* with a somewhat differently colored interior region 410*b* (e.g., the interior region 410*b* may be the same general color as the border region 410*a*, but perhaps a somewhat lighter or less fluorescent shade).

FIG. 4 generally illustrates another feature that may be provided in putter structures according to at least some examples of this invention. Specifically, putters in accordance with examples of this invention may include a shaft member 408 that is colored and/or otherwise finished in the same color(s) and/or finish as the majority of the top surface 406 of the club head body 402 (e.g., in one or more dark colors (such as green, black, brown, dark gray, and/or dark tan) having a dull, matte finish). Putter shafts, which are typically made from steel, generally have a chrome, stainless steel, or other shiny finish. This can be visually distracting to the golfer, as light reflects off this shiny surface. Moreover, changes in reflectance can be visually distracting, particularly as the putter moves during a swing, which can cause the user to slightly flinch or move and cause the club head to move off its intended line and/or the putt to be propelled off its intended line. By providing a dark color and/or a dull, matte finish on at least a portion of the putter shaft 408 located adjacent to the club head 402, reflectance off the shaft 408 will be reduced and the shaft 408 will better blend in to the club head body 402 (and thereby provide reduced visual distractions).

As noted above, at least a portion of the shaft 408 nearest to the club head body 402 may be formed so as to have a non-reflective, matte type finish, optionally in a dark color, such as green, black, brown, dark gray, or dark tan. This feature may be applied to any of the specific putter head structures described and/or illustrated in this specification and drawings. The matte finish may be applied to the shaft 408 in any desired manner without departing from this invention, such as by painting, by anodizing or other electroplating techniques, or the like. If desired, the shaft 408 may be produced in a "unitized" manner with the club head 402, as described for example in U.S. Published Patent Appln. No. 2006/0252572 A1 and owned by NIKE, Inc., which publication is entirely incorporated herein by reference, and/or in the manner of the "Unitized" Putter Series of putter products commercially available from NIKE, Inc. of Beaverton, Oregon.

Figure 5:
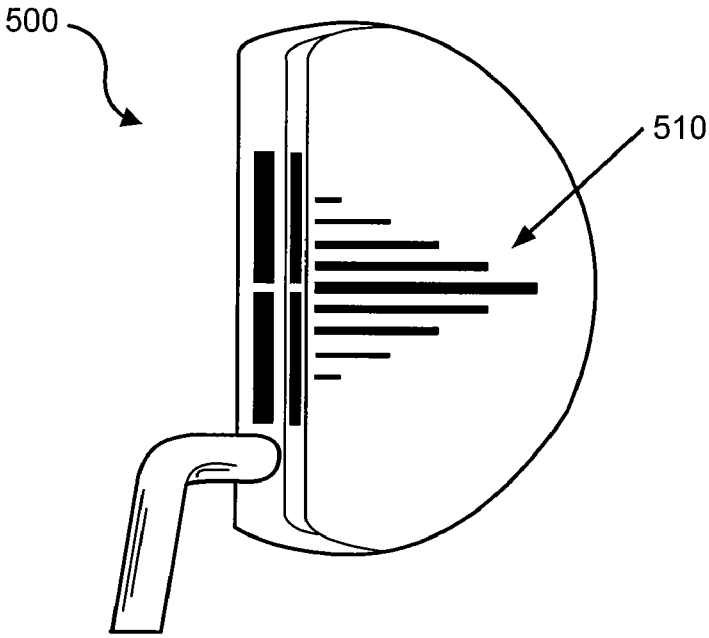
Figure 6:
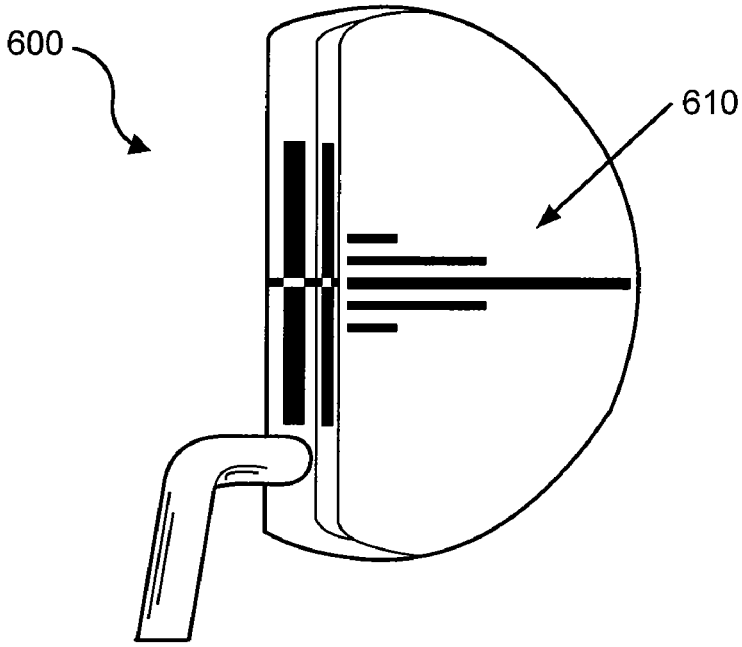

FIGS. 5 and 6 illustrate additional putter structures 500 and 600, respectively, similar to that illustrated in FIG. 4, but with somewhat different alignment aid structures (510 and 610, respectively). These figures illustrate that the alignment aids can take on a wide variety of different configurations without departing from the invention. In these example structures, the rear located alignment aids 510 and 610 generally take on a triangular shaped appearance through a series of parallel lines. The differing lengths of the various lines and their differing thicknesses help draw the golfer's eye toward the front center of the club head body in a manner similar to the triangle structures described above. The figures also illustrate various other potential variations in the overall club head 500/600 and the forward located alignment aid structures that may be provided in accordance with at least some examples of this invention.

Figure 7:
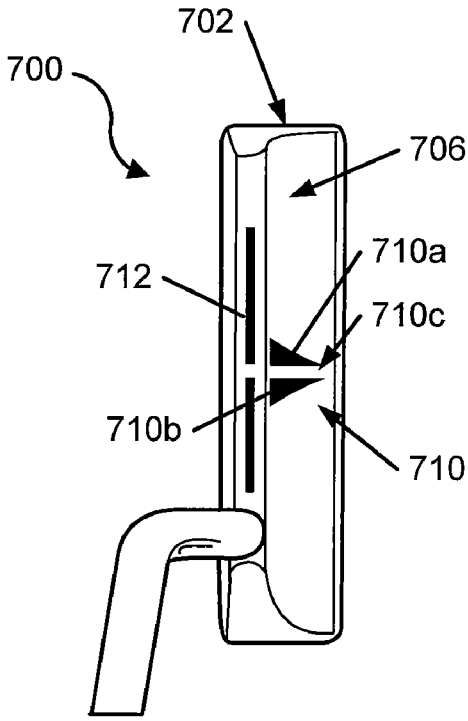
Figure 8:
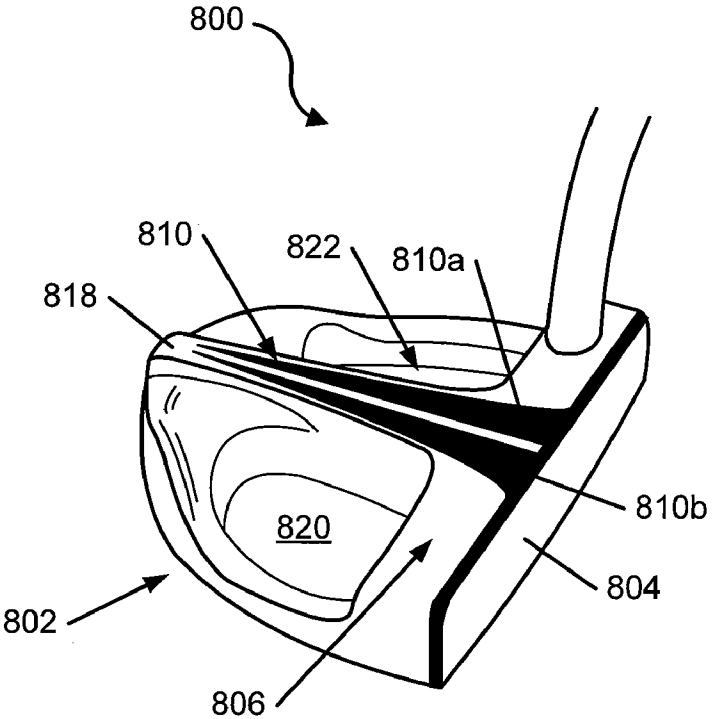

FIGS. 7 and 8 illustrate additional example putter structures 700 and 800, respectively, with still different types of alignment aids in highly contrasting colors from their respective top surfaces 706 and 806. As shown in FIG. 7, this blade type putter head 702 includes a rear alignment aid 710 that is generally triangular shaped, but the triangle shape is broken into two halves 710*a* and 710*b* with an intermediate portion 710*c* running down its length. This intermediate portion 710*c* may be the same color as the majority of the top surface 706, or it may be another color (e.g., that contrasts from the top surface 706 or from the two halves 710*a* and 710*b*). While each of the two halves 710*a* and 710*b* are generally right triangular shaped in this illustrated example alignment aid 710, the long side (or hypotenuse) of these triangular halves 710*a* and 710*b* need not be a straight line, but may be somewhat curved. Nonetheless, in addition to the two triangular halves 710*a* and 710*b*, the overall alignment aid 710 is generally triangular shaped (optionally with one or more curved side edges).

FIG. 8 illustrates a putter structure 800 with a rear alignment aid 810 similar to that shown in FIG. 7 (e.g., with two generally right triangular shaped halves 810*a* and 810*b*), although this rear alignment aid 810 is longer due to the deeper (front to back) dimensions of this mallet type putter head 802. In this example structure 800, the rear alignment aid 810 is located on a ridge 818 extending along the putter head 802 from face 804 to the rear central area. To reduce the putter head 802 weight (and optionally to allow weight to be located at other desired locations in the putter head body 802, such as toward the rear corners), the central/side areas 820 and 822 along ridge 818 may be reduced in thickness or even completely removed (to open two holes through the head 802 and expose the ground through the head 802). Also, the rear alignment aid 810 in this example structure 800 extends completely to the putter face 804, which may be integrally formed with the putter head body 802 or separate therefrom (and engaged to it, e.g., by cements or adhesives; by mechanical connectors; by welding, solder, brazing, or other fusing techniques, etc.). Mallet type putters of this type may come in a variety of overall shapes, sizes, and configurations without departing from the invention.

If desired, the putter structure of FIG. 8 (or indeed any of the putter structures described herein) may be fitted with or designed to include ports or other structures for receiving one or more removable and/or detachable weights (e.g., threaded receptacles for receiving a screw element that attaches a weight to the putter head, clips or other retaining structures, etc.). This feature, when present, may allow users or club fitters to custom fit or custom weight the putter head, e.g., to match user preferences, to compensate for swing flaws, to better match green speed or other play conditions, etc. If desired, the putter may be marketed with one or more weights and a tool for removing/attaching the weight(s), so that the user could selectively change weights, change overall putter weight, change weight positions, etc.

As mentioned above, in accordance with at least some examples of this invention, the majority of the top surface of putter heads in accordance with examples of this invention may be finished in a dull matte finish, in a dark color, such as green, black, brown, dark gray, dark tan, etc. This feature can help mask luminous (brightness) contrast between the club head and ground and thereby highlight and allow the golfer to better focus attention on the highly contrasting (e.g., luminescent and/or light reflective) alignment aids. If desired, more can be done in an effort to "camouflage" the club head's top surface. Specifically, if desired, in accordance with at least some examples of this invention, the color of the top surface of the putter may be selected so as to mimic or blend in with the color of grass on a green (thereby masking both luminous (brightness) and chromatic (color) contrast between the putter top surface and the background). In this manner, when a golfer looks down at the putter from the ball address orientation, the top surface of the putter head will better blend into the green (i.e., the background), which can further help the alignment aids stand out to the golfer's eye.

The top surface of the putter head also need not be finished in a single color. Rather, if desired, multiple colors may be used, such as: multiple shades of green in a matte finish to blend with grass colors, blades of grass, shadowing, etc.; combinations of one or more shades of green with one or more shades of brown/tan, black/gray, and/or combinations thereof, in a matte finish to mimic grass colors, blades of grass, shadowing, underlying sand or soil on the ground, etc.; other camouflaging combinations of colors and finishes.

Figure 9:
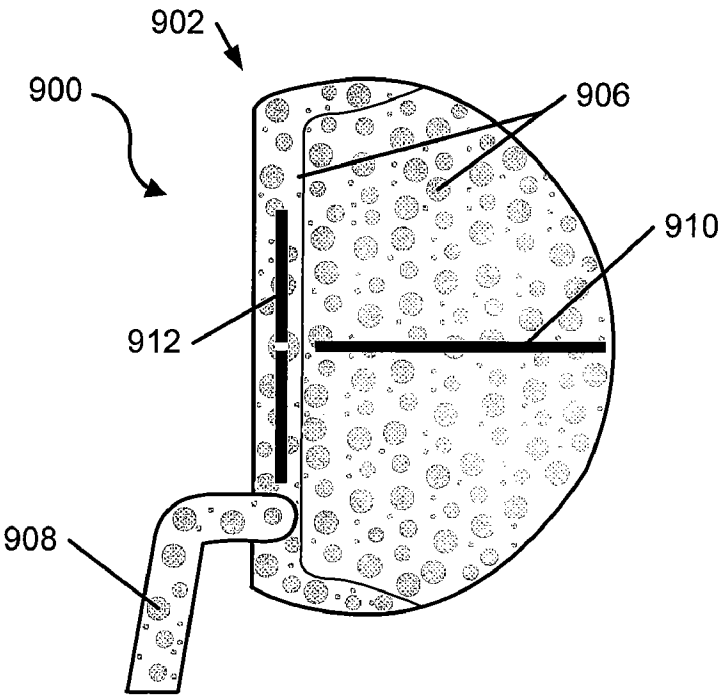
FIG. 9 illustrates another example putter structure including features according to at least some example aspects of this invention.

FIG. 9 illustrates an example putter 900 similar to those illustrated in other figures. In FIG. 9, however, the putter head 902's top surface 906 includes multiple colors (e.g., the background matte color with other colors in the grayed areas) in a camouflaged manner. Any desired camouflaging pattern of colors (or a randomized combination and/or pattern of colors) may be used without departing from this invention. Likewise, in this example structure 900, at least the end of the putter shaft 908 adjacent the putter head 902 is colored and/or finished in a manner the same as or similar to that of the putter top surface 906. Any desired camouflaging pattern(s) and/or combinations of colors also may be used on the putter shaft 908. Again, as described above, the alignment aid(s) 910 and 912 in this example arrangement (which cover less than a majority of the top surface 906) may be produced or finished in a contrasting, luminous, and/or reflective color so as to stand out on the putter head top surface 906 to the golfer's eye. Any desired alignment aid or combination of alignment aids may be used in combination with the "grass colored" top surface finished putter head and/or shaft member without departing from the invention, including the various alignment aid features described above.

Figure 10:
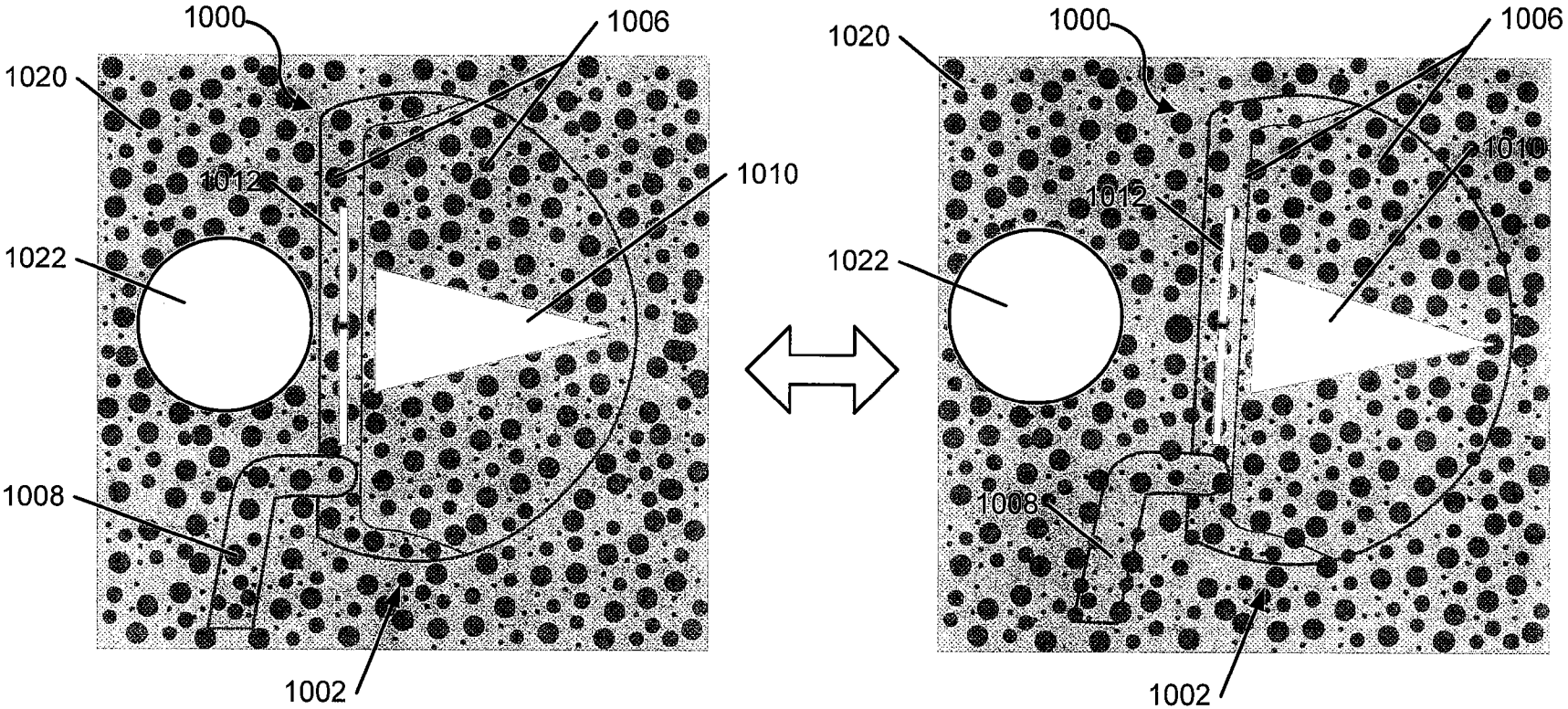
FIG. 10 illustrates movement of a "camouflaged" putter structure including features according to at least some example aspects of this invention.

FIG. 10 illustrates motion of a putter 1000 including a shaft 1008 and a putter head 1002 top surface 806 colored and/or finished to reduce both luminous contrast and chromatic contrast with its background 1020 (i.e., colored and/or finished to better match the grass of the green, as described above). The putter 1000 also may have any of the other various characteristics described above, e.g., characteristics described in conjunction with FIGS. 1 through 9. By coloring and/or finishing the putter head 1002 top surface 1006 in this manner (and optionally reducing sharp corners or edges), as illustrated in FIG. 10, visual distractions are reduced because the putter head 1002 does not "stand out" as much to the golfer's eye against the similarly colored green background 1020. Moreover, this feature helps the alignment aid(s) 1010 and 1012 better stand out to the golfer's eye and better allow focus on alignment of the ball 1022 in the desired direction using the alignment aids 1010 and 1012.

Features of the invention as described in conjunction with FIGS. 9 and 10 provide a variety of additional features that may be included in putter heads in accordance with examples of this invention. For example, putter head top surface colors and/or finishes may be specifically designed or customized to better match: the color of grass on one or more greens on a specific golf course; the color of grass on greens in a specific geographic region (e.g., the Pacific Northwest, the Southwest, Florida, Arizona, Europe, etc.); the color of grass on greens of a particular type or breed (e.g., bent grass, Bermuda grass, etc.); the color of grass on greens at various different times of year; the color of grass on greens at particular playing times (e.g., early morning, mid-day, late afternoon, dusk, etc.); the color of grass on greens under particular playing conditions (e.g., bright sunlight, cloudy or overcast, rainy, dewy or misty, etc.); etc. Putters may be marketed in accordance with at least some examples of this invention as a kit or a system, wherein a putter shaft is fit with a selectively removable head, and a user may receive (or have access to) multiple heads of different colors (targeted to match a variety of different conditions, as described above), and a user may select a specific head for use during a specific round of golf to better match the conditions. If desired, rather than replacing an entire head, the putter head may be fit with a removable top surface element (covering all or part of the top surface of the putter head) that can be selectively removed and replaced with a top surface element of another color.

Additionally or alternatively, if desired, the putter "kit" or "system" may include multiple putter shafts, in multiple colors, color combinations, or the like, to enable the user to select a specific shaft for use during a specific round of golf to better match the conditions. If desired, rather than replacing an entire shaft, the putter shaft may be fit with a removable sleeve element (covering all or part of the visible portion of the shaft) that can be selectively removed and replaced with a shaft sleeve element of another color.

Any desired manner of actually selecting the colors for the top surface finish and/or shaft member may be used without departing from this invention, including trial and error type methods (e.g., producing putter heads with a variety of different colors, color combinations, finishes, etc.) and determining which of the variety best matches an individual grass color, grass type, time of day, time of year, geographic location, etc. Alternatively, if desired, spectral data (e.g., color absorption data, color reflectance data, luminance data, etc.) may be measured for specific grasses (e.g., on a specific golf course; in a specific geographic region; for particular types or breeds of grass), optionally under various conditions (e.g., at different times of year; at different times of day; under different playing or lighting conditions), and this data may be used to assist in selecting colors of paint or other finishes for the club head top surface and/or shaft (matching paint to existing known colors is well known in the paint arts). Spectral data of this type may be used, if desired, to determine customized club head top surface and/or shaft colors for a specific golf course and/or other conditions, if desired. Measuring grass colors using digital image analysis is known, for example, as described by D. E. Karcher, et al., "Turfgrass Science: Quantifying Turfgrass Color Using Digital Image Analysis," *Crop Science*, Vol. 43, May-June, 2003, pp. 943-951, which article in entirely incorporated herein by reference.

Many modifications to the overall putter head structures and/or the overall putter structures may be made without departing from this invention. For example, many modifications may be made to the part or parts making up the club head structures, to the materials used in making the club structures, to the manner in which the parts of the club head structures are joined together, etc. Also, many modifications may be made to the thickness, weight, shape, size, and/or other physical characteristics of the part or parts making up the overall club structures, etc. Further modifications may be made in the manner in which the putter head and its associated parts are made, including modifications in the specific processes used to make the parts, modifications in the materials used to make the parts, modifications to the order in which the parts are made and the club head is assembled, and the like. Aspects of this invention may be practiced on putter heads and putters of conventional shapes and/or constructions, including putter heads and putters in commercially available shapes, constructions, and designs. Such putter heads and putters may include a variety of features, such as adjustable weights, one or more openings in the body portion through which the green is visible, etc.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A putter head, comprising:

a club head body having a ball striking face, a top surface when viewed from a ball address orientation, a ridge extending along the club head body from the ball striking face to a rear center area of the club head body, and two central areas located along the ridge defined by two open holes through the club head body, wherein a majority of the top surface has a non-reflective, matte finish, and wherein the color or colors of the matte finish are selected so as to substantially blend into or substantially match a color of a grass on a golf green; and an alignment aid provided on or integrally formed as part of the top surface, wherein a first portion of the alignment aid includes a first generally right-triangular half and a second generally right-triangular half separate from the first generally right-triangular half, wherein the first right-triangular half and the second right-triangular half are located on the ridge, and wherein the alignment aid is formed in one or more contrasting colors and covers less than a majority of the top surface of the club head body.

2. A putter head according to claim 1, wherein the top surface of the club head body includes a ball striking face portion and a main body portion extending from the ball striking face portion and away from the ball striking face.

3. A putter head according to claim 2, wherein the first portion of the alignment aid is located on or integrally formed as part of the main body portion.

4. A putter head according to claim 3, wherein the alignment aid includes a second portion located on or integrally formed as part of the ball striking face portion.

5. A putter head according to claim 4, wherein the second portion of the alignment aid includes a line or an elongated substantially polygon shaped element extending along the ball striking face portion.

6. A putter head according to claim 4, wherein the first generally right-triangular half of the alignment aid includes a first flat side proximate to and extending substantially parallel to the ball striking face and a first single apex area located toward a center rearmost portion of the main body portion, and wherein the second generally right-triangular half of the alignment aid includes a second flat side proximate to and extending to the ball striking face and a second apex area located toward the center rearmost portion of the main body.

7. A putter head according to claim 2, wherein the alignment aid includes a second portion located on or integrally formed as part of the ball striking face portion.

8. A putter head according to claim 7, wherein the second portion of the alignment aid includes a line or an elongated substantially polygon shaped element extending along the ball striking face portion.

9. A putter head according to claim 1, wherein the top surface of the club head body includes no structural sharp corners visible from the ball address orientation.

10. A putter head according to claim 1, wherein the top surface of the club head body includes no abrupt surface elevation changes visible from the ball address orientation.

11. A putter head according to claim 1, wherein the top surface of the club head body includes smoothly rounded structural corners and smoothly transitioned surface elevation changes.

12. A putter head according to claim 1, wherein the top surface has coloring consisting essentially of: (a) the non-reflective, matte finish and (b) the alignment aid formed in the one or more highly contrasting colors.

13. A putter head according to claim 1, wherein at least 90% of the top surface coloring includes: (a) the non-reflective, matte finish and (b) the alignment aid formed in the one or more highly contrasting colors.

14. A putter head according to claim 1, wherein at least 95% of the top surface coloring includes: (a) the non-reflective, matte finish colors and (b) the alignment aid formed in the one or more highly contrasting colors.

15. A putter head comprising:

a club head body having a ball striking face, a top surface when viewed from a ball address orientation, a ridge extending along the club head body from the ball striking face to a rear center area of the club head body, and two central areas located along the ridge defined by two open holes through the club head body, wherein a majority of the top surface has a non-reflective, matte finish, and wherein the color or colors of the matte finish are selected so as to substantially blend into or substantially match a color of a grass on a golf green, the top surface of the club head body having a ball striking face portion and a main body portion extending from the ball striking face portion and away from the ball striking face; and an alignment aid provided on or integrally formed as part of the main body portion, wherein a first portion of the alignment aid includes a first generally right-triangular half and a second generally right-triangular half separate from the first generally right-triangular half, wherein the first right-triangular half and the second right-triangular half are located on the ridge, wherein the first generally right-triangular half of the alignment aid includes a first flat side proximate to and extending substantially parallel to the ball striking face and a first single apex area located toward a center rearmost portion of the main body portion, and wherein the second generally right-triangular half of the alignment aid includes a second flat side proximate to and extending to the ball striking face and a second apex area located toward the center rearmost portion of the main body, wherein a second portion of the alignment aid includes a line or an elongated substantially polygon shaped element extending along the ball striking face portion substantially parallel to the first and second flat sides of the first portion of the alignment aid and the second portion of the alignment aid is located on or integrally formed as part of the ball striking face portion, and wherein the alignment aid is formed in one or more contrasting colors and covers less than a majority of the top surface of the club head body.

16. A putter head, comprising:

a club head body having a ball striking face and a top surface when viewed from a ball address orientation, a ridge extending along the club head body from the ball striking face to a rear center area of the club head body, and two central areas located along the ridge defined by two open holes through the club head body, wherein a majority of the top surface has a non-reflective, matte finish, and wherein the color or colors of the matte finish are selected so as to substantially blend into or substantially match a color of a grass on a golf green; and a first alignment aid provided on or integrally formed as part of the top surface, wherein the first alignment aid is generally triangular shaped and includes two generally right-triangular halves with an intermediate portion extending along a length of the first alignment aid from the ball striking face to a rear center area, wherein the intermediate portion separates the two right-triangular halves, wherein the two generally right-triangular halves are located on the ridge, wherein the first alignment aid is formed in one or more contrasting colors and covers less than a majority of the top surface of the club head body, and wherein the intermediate portion matches the color or colors and finish of the majority of the top surface.

17. A putter head according to claim 16, wherein the first alignment aid is located on the ridge.

18. A putter head according to claim 17, wherein each of the two separate generally right triangular halves of the first alignment aid includes a flat side proximate to and extending substantially parallel to the ball striking face and a single apex area located toward a center rearmost portion of the club head body.

19. A putter head according to claim 18, further including a second alignment aid provided on or integrally formed as part of the top surface, and located on or integrally formed as part of the ball striking face, wherein the second alignment aid is formed in one or more highly contrasting colors and covers less than a majority of the top surface of the club head body.

20. A putter head according to claim 19, wherein the second alignment aid includes a line or an elongated substantially polygon shaped element extending along the ball striking face.

21. A putter head according to claim 19, wherein the second alignment aid includes a line or an elongated substantially polygon shaped element extending along the ball striking face substantially parallel to the flat sides of the first alignment aid.

* * * * *